US007097534B1

(12) United States Patent
Yampolskiy et al.

(10) Patent No.: US 7,097,534 B1
(45) Date of Patent: Aug. 29, 2006

(54) CLOSED-LOOP CONTROL OF A CHEMICAL MECHANICAL POLISHER

(75) Inventors: Arkadiy Yampolskiy, Mountain View, CA (US); Masoud Aslan, Greenville, TX (US)

(73) Assignee: Applied Materials, Inc., Santa Clara, CA (US)

( * ) Notice: Subject to any disclaimer, the term of this patent is extended or adjusted under 35 U.S.C. 154(b) by 638 days.

(21) Appl. No.: 09/903,052

(22) Filed: Jul. 10, 2001

Related U.S. Application Data

(60) Provisional application No. 60/217,224, filed on Jul. 10, 2000.

(51) Int. Cl.
*B24B 49/00* (2006.01)

(52) U.S. Cl. ..... 451/5; 451/28

(58) Field of Classification Search ..... 451/5–10, 451/41, 28, 285–288, 63, 65
See application file for complete search history.

(56) References Cited

U.S. PATENT DOCUMENTS

| | | | | |
|---|---|---|---|---|
| 5,486,129 | A | 1/1996 | Sandhu et al. | |
| 5,658,183 | A | 8/1997 | Sandhu et al. | |
| 5,664,985 | A * | 9/1997 | Williams et al. | 451/5 |
| 5,679,055 | A * | 10/1997 | Greene et al. | 451/10 |
| 5,730,642 | A | 3/1998 | Sandhu et al. | |
| 5,964,643 | A * | 10/1999 | Birang et al. | 451/6 |
| 6,157,078 | A | 12/2000 | Lansford | |
| 6,159,073 | A | 12/2000 | Wiswesser et al. | |
| 6,261,152 | B1 | 7/2001 | Aiyer | |
| 6,291,253 | B1 | 9/2001 | Lansford et al. | |
| 6,829,054 | B1 | 12/2004 | Stanke et al. | |
| 2001/0015811 | A1 | 8/2001 | Ravid et al. | |
| 2001/0026364 | A1 | 10/2001 | Ravid et al. | |
| 2002/0005957 | A1 | 1/2002 | Moshe et al. | |
| 2002/0146970 | A1 * | 10/2002 | Saldana et al. | 451/285 |

FOREIGN PATENT DOCUMENTS

| | | |
|---|---|---|
| JP | 9148284 | 6/1997 |
| WO | WO 99/25520 | 5/1999 |

OTHER PUBLICATIONS

Pan, J. Tony, et al., "Copper CMP and Process Control," Final Paper submitted to CMP-MIC Conference, Feb. 11-12, 1999, Santa Clara, CA and Cambridge, MA, 7 pp.
Ravid, Avi, et al., "Copper CMP Planarity Control Using ITM," IEEE/SEMI Advanced Semiconductor Manufacturing Conference, 2000, pp. 437-443.

* cited by examiner

*Primary Examiner*—Lee D. Wilson
(74) *Attorney, Agent, or Firm*—Fish & Richardson

(57) ABSTRACT

A method of controlling a chemical mechanical polishing system in which an inner tolerance, an outer tolerance and a specification tolerance limit are received by a control system. The user selects one of the inner tolerance and the outer tolerance, and the user selects a polishing machine procedure for the selected tolerance. A first substrate is polished with the chemical mechanical polishing system, and a thickness of at least one layer in the substrate is measured at an in-line metrology station. If the measured thickness exceeds the selected tolerance, the selected procedure is performed.

16 Claims, 4 Drawing Sheets

CLOSED-LOOP CONTROL OF A CHEMICAL MECHANICAL POLISHER

CROSS-REFERENCE TO RELATED APPLICATIONS

This application claims priority to Provisional U.S. Application Ser. No. 60/217,224, filed on Jul. 10, 2000.

BACKGROUND

The present invention relates generally to chemical mechanical polishing of substrates, and more particularly to control systems for a chemical mechanical polishing apparatus.

Integrated circuits are typically formed on substrates, particularly silicon wafers, by the sequential deposition of conductive, semiconductive or insulative layers. After each layer is deposited, it is etched to create circuitry features. As a series of layers are sequentially deposited and etched, the outer or uppermost surface of the substrate, i.e., the exposed surface of the substrate, becomes increasingly non-planar. This non-planar surface presents problems in the photolithographic steps of the integrated circuit fabrication process. Therefore, there is a need to periodically planarize the substrate surface.

Chemical mechanical polishing (CMP) is one accepted method of planarization. This planarization method typically requires that the substrate be mounted on a carrier or polishing head. The exposed surface of the substrate is placed against a rotating polishing pad. The polishing pad may be either a "standard" or a fixed-abrasive pad. A standard polishing pad has durable roughened surface, whereas a fixed-abrasive pad has abrasive particles held in a containment media. The carrier head provides a controllable load, i.e., pressure, on the substrate to push it against the polishing pad. A polishing slurry, including at least one chemically-reactive agent, and abrasive particles, if a standard pad is used, is supplied to the surface of the polishing pad.

Problems in CMP is overpolishing (the removal of too much material from the substrate) and underpolishing (the removal of too little material from the substrate) of the substrate. Both underpolishing and overpolishing reduce the substrate yield.

A conventional control method 500 for making the wafer layer thickness match a desired thickness is illustrated in FIG. 5. Initially, a preset polishing time is selected for qualifying wafers that should result in nominal underpolishing (step 502). Several qualifying wafers, e.g., one to four wafers, are polished for this preset polishing time (step 504) and then cleaned and dried (step 506). The qualifying wafers are then transferred to a stand-alone thickness metrology device that measures the thickness of the one or more layers of the substrate (step 508). Steps 502–508 typically take about one-half to two hours. Based on the thickness measurements, the operator of the polishing apparatus manually adjusts the polishing time so that the resulting layer thickness should match the desired target thickness (step 510).

When device wafers are to be polished, they are polished by lot using the adjusted polishing time (512), cleaned and dried (step 514), and transferred by lot to the stand-alone thickness metrology device for measurement of the layer thickness of one or more of the wafers (step 516). If the device wafers are underpolished, they are reworked by sending them back to the polishing apparatus for additional polishing (step 518), and the polishing time is again manually adjusted (step 510), e.g., increased, so that the resulting layer thickness more closely matches the desired target thickness. On the other hand, if the device wafers are overpolished, they must be scrapped (step 520), and the polishing time is again manually adjusted, e.g., decreased, so that the resulting layer thickness more closely matches the desired target thickness. Once the device wafers have been polished, any underpolished qualification wafers are repolished (step 522).

Unfortunately, this conventional process has several problems. There is significant potential for miscalculation of the polishing time, and when the polishing time is incorrect, and entire lot of substrates is misprocessed. The frequency of monitoring is low, so that if the process parameters drift, resulting in a drift in the polishing rate, the polishing apparatus is unable to compensate. In addition, manual calculation of the polishing time is operator intensive and prone to error, and there is extensive non-productive time while the polishing apparatus idles after the qualifying wafers have been processed.

SUMMARY

In one aspect, the invention is directed to a method of controlling a chemical mechanical polishing system. In the method, an inner tolerance, an outer tolerance and a specification tolerance limit are received, user input selecting one of the inner tolerance and the outer tolerance is received, and user input selecting a polishing machine procedure for the selected tolerance is received. A first substrate is polished with the chemical mechanical polishing system, and a thickness of at least one layer in the substrate is measured at an in-line metrology station. If the measured thickness exceeds the selected tolerance, the selected procedure is performed.

Implementations of the invention may include one or more of the following features. The selected procedure may include adjusting a polishing time of a second substrate from the same cassette as the first substrate, adjusting a polishing time of a second substrate from a different cassette from the first substrate, displaying a warning message, or generating a gating substrate in the next cassette.

In another aspect, the invention is directed to a method of chemical mechanical polishing. A first substrate of a lot is polished at a polishing station of a chemical mechanical polishing apparatus that includes an in-line metrology station. A thickness of at least one layer in the first substrate is measured at the in-line metrology station, a polishing parameter is adjusted based on the measurement of the first substrate, and a second substrate of the lot is polished at the polishing station with the adjusted polishing parameter.

Implementations of the invention may include one or more of the following features. The thickness of the at least one layer may be measured while a third substrate is being polished, and the second substrate may be polished after the third substrate. The polishing parameter may be adjusted if the measured thickness exceeds a tolerance limit. The tolerance limit may be entered by a user, and the polishing parameter may be a polishing time.

In another aspect, the invention is directed to a method of chemical mechanical polishing. A cassette is received with a plurality of substrates at a chemical mechanical polishing apparatus. A gating substrate from the cassette is polished, and a thickness of at least one layer in the gating substrate is measured at an in-line metrology station to determine whether the measured thickness exceeds a tolerance. If the measured thickness is within the tolerance, polishing of the remainder of substrates from the cassette commences, whereas if the measured thickness is outside the tolerance, polishing of the gating substrate recommences.

Implementations of the invention may include one or more of the following features. Polishing of the remainder of the substrates may include polishing a monitor substrate and measuring a thickness of at least one layer in the monitor substrate at the in-line metrology station. A polishing parameter may be adjusted based on the measured thickness of the at least one layer in the monitor substrate. A first regular substrate may be polished before polishing the monitor substrate, and a second regular substrate may be polished after polishing the monitor substrate using the adjusted polishing parameter. The first and second regular substrates need not be directed to the in-line metrology station.

In another aspect, the invention is directed to a method of chemical mechanical polishing in which a cassette with a plurality of substrates is received at a chemical mechanical polishing apparatus, and an electronic file containing a wafer type for each substrate in the cassette is received at a controller for the polishing apparatus. The wafer type is determined for each substrate. If the wafer type is a first type, then the substrate is polished, a thickness of at least one layer of the substrate is measured at an in-line metrology station, and further substrates from the cassette are not permitted to be polished if the thickness exceeds a first tolerance. If the wafer type is a second type, then the substrate is polished, a thickness of at least one layer of the substrate is measured at the in-line metrology station, and a polishing parameter is adjusted for future substrates from the cassette. If the wafer type is a third type, then the substrate is polished but is not directed to the in-line metrology station.

Advantages of the invention may include the following. Underpolishing and overpolishing are reduced, thereby improving substrate yield. Substrates can be routed dynamically based on measurement results. Substrates with different incoming thickness can be polished uniformly.

Other advantages and features of the invention will be apparent from the following description, including the drawings and claims.

DETAILED DESCRIPTION

Figure 1:
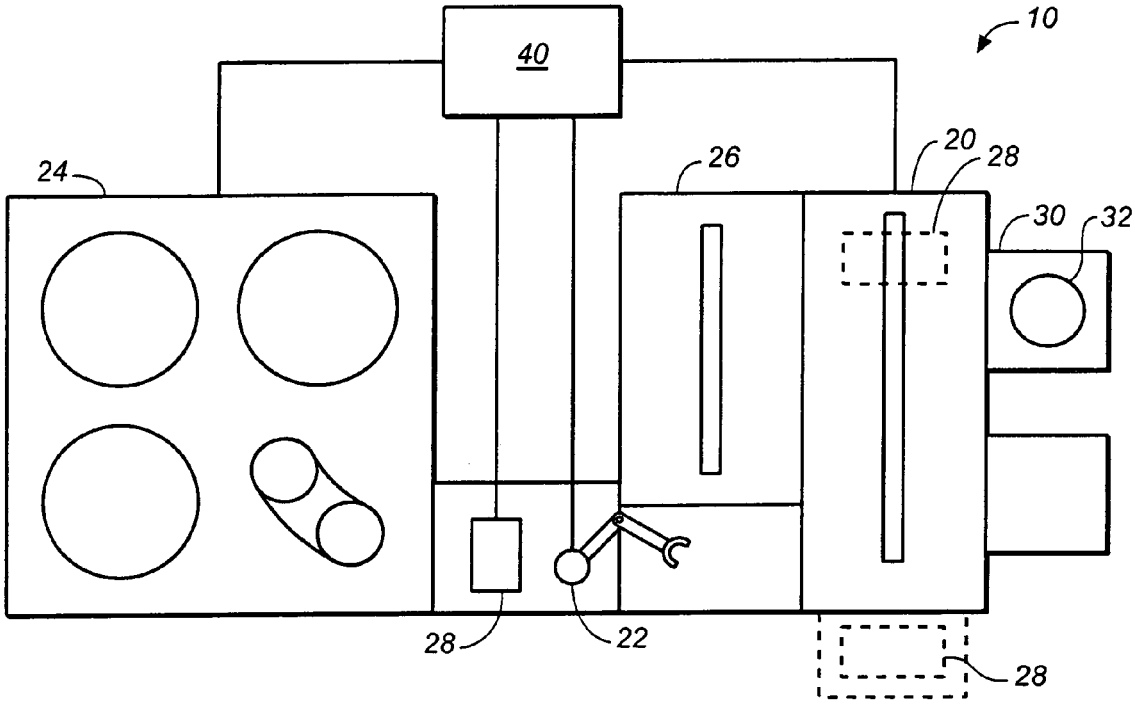
FIG. 1 is a schematic top view of a chemical mechanical polishing (CMP) system.

Referring to FIG. 1, one or more substrates will be polished by a chemical mechanical polishing (CMP) system 10. The CMP system typically includes a factory interface unit 20 for loading substrates to and from the cleanroom, one or more substrate transfer robots 22 to move substrates from the factory interface unit into the remainder of the system 10, a multi-station polishing apparatus 24 for polishing and buffing the substrate, a cleaning system 26 for cleaning the substrate after polishing, and an in-line metrology device 28 to measure the thickness of one or more layers on the substrate either before or after polishing or cleaning. The factory interface unit 20 supports one or more cassettes 30 that hold one or more wafers 32. A description of a suitable CMP apparatus 20 may be found in U.S. Pat. No. 5,738,574, the entire disclosure of which is hereby incorporated by reference. Suitable metrology devices are manufactured by Nova and Nanometrics. The metrology device might be located adjacent the polishing apparatus 24, or it might be inside the factory interface unit or adjacent the factory interface unit.

A process control system 40 is connected to the components of the CMP system, including at least the factory interface unit 20, the transfer robots 22, the polishing apparatus 24, and the metrology device 28. Thickness measurements from the metrology device 28 are directed to the control system 40, which can adjust the polishing time by the polishing apparatus 24 to ensure uniform wafer-to-wafer polishing. In addition, the control system 40 can dynamically adjust the behavior of the transfer robot 22 to route substrates in response to measurements by the metrology device 28. The control system 40 includes a scheduling system that determines when to transfer substrates from one portion of the CMP system to another.

The control system 40 can be implemented with software on a general-purpose programmable computer, or with hardware or firmware, or some combination of hardware, firmware and software.

Although illustrated as a single device, control system 40 can in fact be multiple devices that exchange messages. For example, there could be one computer for the polishing apparatus 24 and one computer for the metrology device 28. In addition, the computer system 40 can include one or more intermediate computers to transfer messages between the other computers. The calculations and decisions in the control process performed by the control system 40 can be distributed among the computers.

Figure 2:
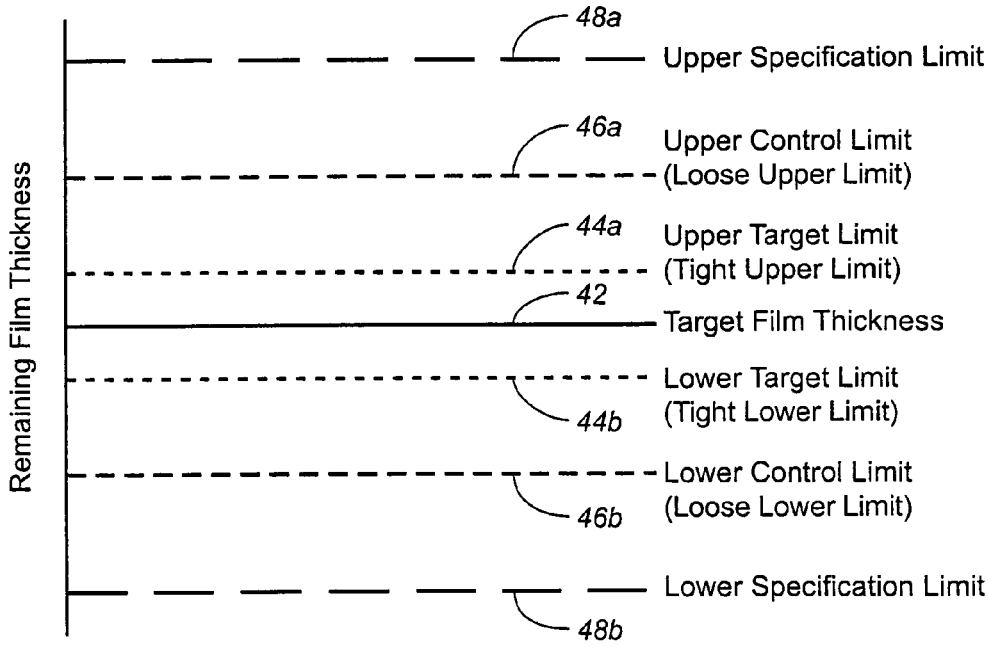
FIG. 2 is a graph illustrating tolerances used in the method performed by the CMP system.

Referring to FIG. 2, the control system 40 stores a target film thickness 42 and a number, e.g., three, of polishing tolerances. Each tolerance includes an upper limit and a lower limit. In one implementation, the computer stores three tolerances, including a target tolerance with upper and lower target limits 44*a* and 44*b*, a control tolerance with upper and lower control limits 46*a* and 46*b*, and a specification tolerance with upper and lower specification limits 48*a* and 48*b*. In general, the target tolerance is narrower than the control tolerance, which is narrower than the specification tolerance.

Alternatively or in addition, the computer could store a target removed thickness (rather than a target thickness) with associated tolerances.

In general, in response to the thickness measurements by the metrology device, the control system 40 can take one of several actions, such as immediately stopping the polishing apparatus and idling, completing polishing of the substrates in the polishing apparatus and then idling, completing polishing of the substrates in the cassette and then idling, adjusting the polishing time for the other substrates in the cassette, adjusting the polishing time of substrates in other cassettes, returning a substrate to the polishing apparatus, creating a gating group (discussed below), and generating warning and/or status messages. The control system 40 can request operator approval prior to adjusting the polishing time or polishing procedure.

One concept that is important to the processing control system of the present invention is "wafer type". Each device substrate being polished is assigned a wafer type, and each substrate is processed in accordance with its assigned wafer type. In general, the control system 40 stores the wafer type for each substrate, and the action initiated by the control system 40 depends on the wafer type of the substrate.

In one implementation, the processing control system uses three different wafer types: gating wafers, monitor wafers and regular wafers.

A gating wafer is directed to the metrology station for measuring of the substrate layer thickness. The thickness measurements may be performed both before and after polishing, or only after polishing (e.g., if the thickness of the incoming substrate is transmitted from some other source). In general, no other substrates may be taken from the cassette for polishing until the gating wafer has been processed. In addition, the gating wafer can be used to determine the preset polishing time at the beginning of a run.

If the layer thickness of a gating wafer as measured by the metrology station is outside of the specification limits, the polishing time is adjusted (upward if underpolished, downward if overpolished), and the next substrate is changed to a gating wafer. Moreover, if the substrate was underpolished, it can be returned to the cassette, and then reworked after the remaining substrates have been processed. If the layer thickness is within the specification limit but outside the target limits, the polishing time is adjusted and the next substrate is changed to a gating wafer, but the original substrate does not need to be reworked. If the layer thickness is within the target limits, the polisher proceeds with polishing of the next substrate without changing the operating parameters.

A monitor wafer is also directed to the metrology station for measuring of the substrate layer thickness, either both before and after polishing, or only after polishing. However, the monitor wafer does not block processing of subsequent substrates. Thus, while the monitor wafer is being polished, cleaned or measured, other substrates can be removed from the cassette and polished.

The monitor wafer is used to track the polishing rate and adjust the polishing time to compensate for any process drift. If the layer thickness of the monitor wafer as measured by the metrology device is outside the specification limit, the polishing time is adjusted for the remainder of the substrates in the cassette, and the substrate is returned to the cassette and then reworked after the remaining substrates have been processed. If the layer thickness is within the specification limit but outside the control limits, the polishing time is adjusted for the remaining substrates, but the original substrate does not need to be reworked. If the layer thickness is within the control limits, the polishing time is not changed.

Regular wafers can be routed to the metrology device if the scheduling system determines that there is sufficient time available to perform a thickness measurement. However, no decisions are based on the thickness of the regular wafer (e.g., the computer does not idle the polisher or adjust the polishing time).

In addition to these wafer types, the operator may create other user-defined wafer types. In the user-defined wafer types, the operator selections one or more of the actions described above for the control system to initiate in response to the substrate layer thickness information from the metrology station. These user-defined wafer types can be created with a graphical user interface.

The operator may create a "recipe" for a cassette. The recipe includes a slot for each substrate in the cassette. Each slot indicates an action (or that there should be no action) if the measured thickness is outside the associate tolerance. In a graphical user interface, this could be implemented with a tab for each tolerance, a checkbox for each wafer to indicate whether the control system should take an action, and a pull-down list for each wafer with possible actions that can be taken if the layer thickness measurement exceeds the tolerance of that tab.

Figure 3:
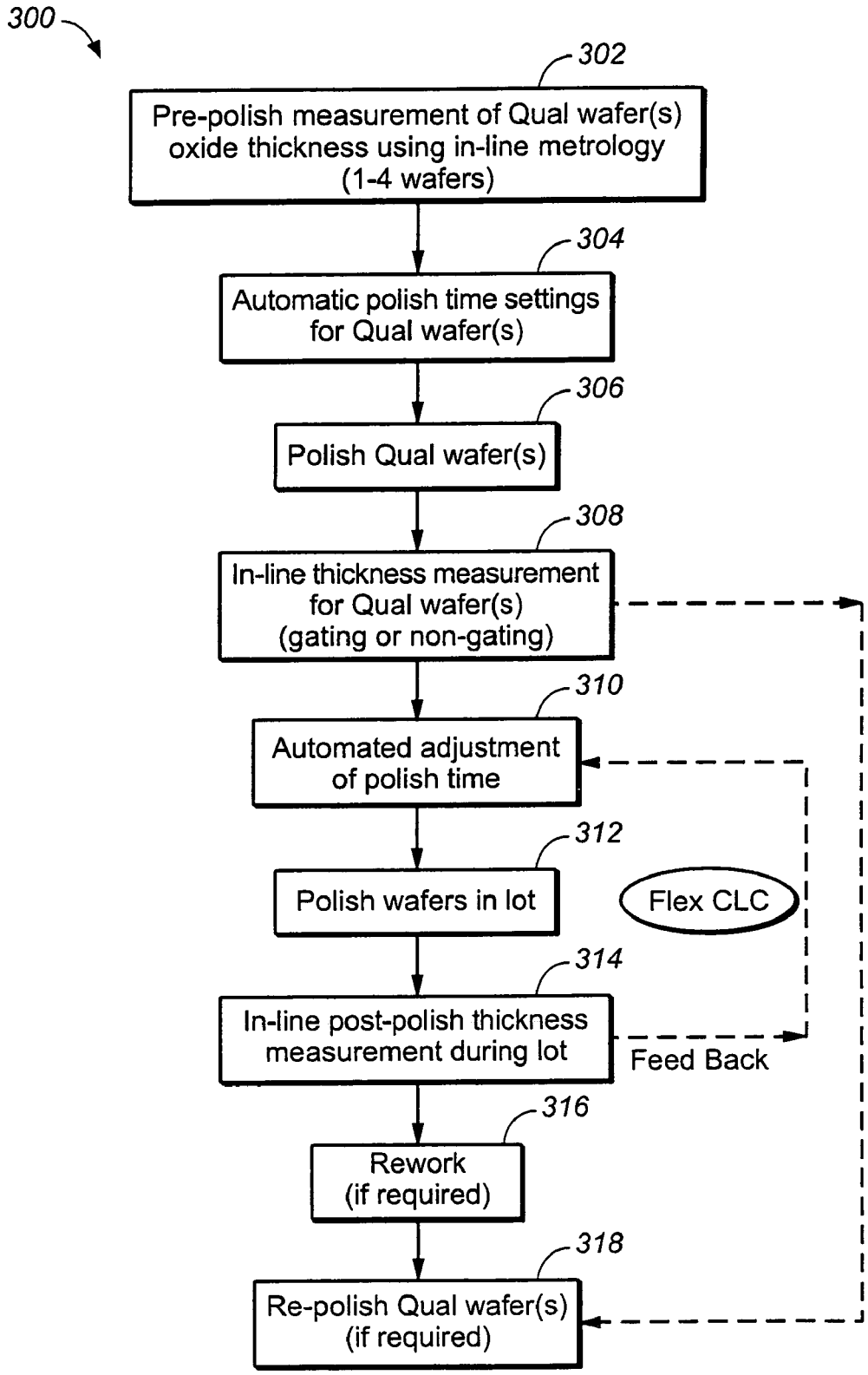
FIGS. 3 and 4 are flowcharts illustrating a method performed by the CMP system.

Referring to FIG. 3, a method 300 performed by the process control system 40 is illustrated. Initially, the layer thickness of each of several qualification substrates, e.g., one to four substrates, is measured by an in-line metrology tool (step 302). Since the in-line metrology is attached to the CMP apparatus 10, the substrate does not need to be transported to a different section of the clean room. The polishing time for each qualification substrate is set (step 304), e.g., by subtracting the target thickness from the actual thickness measured in step 302 to determine the thickness of material to remove, and then dividing the thickness of material to remove by a previously experimentally determined polishing rate. Alternatively, the adjustment can be simply proportional (e.g., 10% overpolishing results in 10% reduction in polishing time) or based on a look-up-table that provides a more complex relationship. The qualification substrates are polished (step 306) and directed to the in-line metrology device for a post-polish thickness measurement (step 308). The qualification substrates can be classified as gating or measurement wafers.

Based on the thickness measurements in step 308, the thickness of material actually removed can be calculated and the default polishing time can again be adjusted (step 310). For example, the polishing rate can be recalculated based on the amount of material actually removed and the polishing time.

Once polishing of the qualification substrates is complete, each substrate in the cassette can be polished in turn (step 312). The substrates that are classified as monitor wafers are sent to the in-line metrology station for post-polish thickness measurement. The substrate layer thickness for these monitor wafers is measured, and if the resulting thickness is outside the control limits, the information is fed back to automatically adjust the polishing time (step 314). For example, the polishing rate can be recalculated based on the amount of material actually removed and the polishing time for the monitor wafer, and then a new polishing time can be calculated based on the new polishing rate. If the substrate was underpolished, it can be returned to the polishing apparatus for rework (step 316). If the scheduler in the control system 40 determines that there is sufficient available time, the substrates that are classified as regular wafers can also be sent to the in-line metrology station for post-polish thickness measurement. However, the polishing time is not adjusted based on the measurements of the regular wafer. The metrology device 28 can also measure within-wafer-nonuniformity of the regular and monitor substrates. Once the polishing of the regular and monitor wafers is complete, the qualification substrates that were underpolished can be repolished (step 318).

Figure 4:
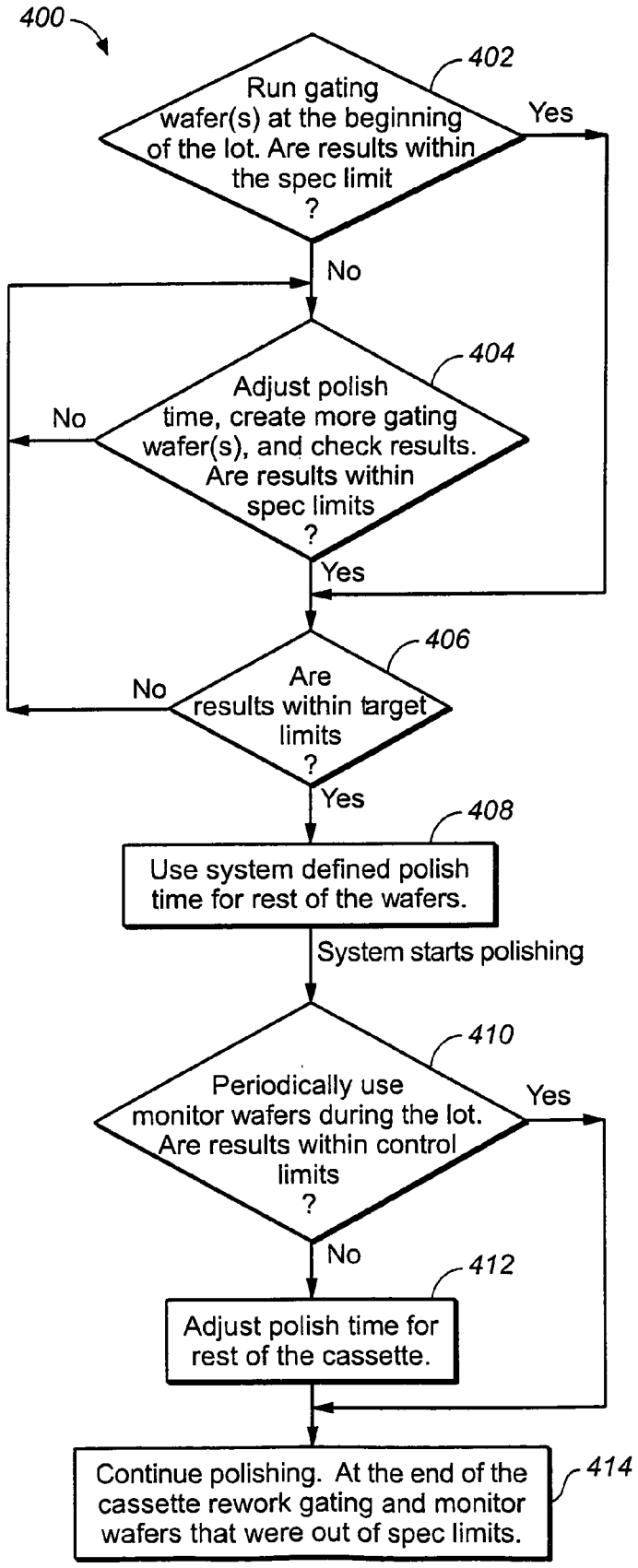
Figure 5:
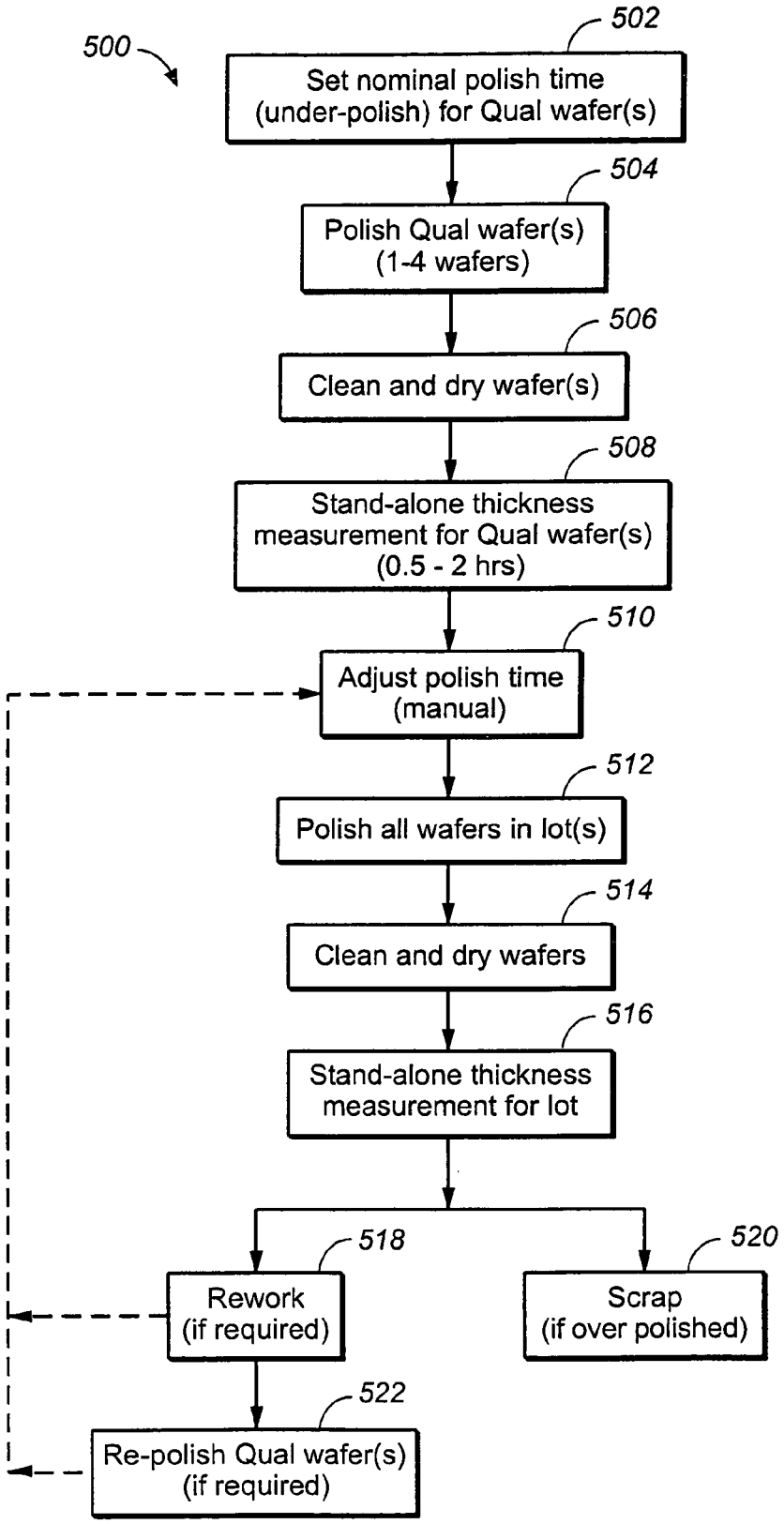
FIG. 5 is a flowchart illustrating a conventional polishing control method.

Referring to FIG. 4, another aspect of the method 400 performed by the process control system 40 is illustrated. This method assumes that the first substrate in the cassette is classified as a gating wafer, some of the substrates in the cassette are classified as monitor wafers, and the remaining substrates are classified as regular wafers. Typically, the monitor wafers are interspersed with the regular wafers.

Initially, the gating wafer is extracted from the cassette, run through the polishing apparatus, and directed to the in-line metrology device (step 402). While the gating wafer is being processed, the rest of the substrates are not processed. If the resulting layer thickness on the first gating wafer is outside the specification limits or the target limits, the polishing time is adjusted, and the next substrate in the cassette is classified as a second gating wafer, extracted from the cassette, run through the polishing apparatus, and directed to the in-line metrology device (steps 404 and 406). The control system continues to classify substrates as gating wafers until one has a layer thickness within the target limits (step 406). At this point, the previously calculated polishing time is set as the default polishing time (step 408), and polishing of the rest of the substrates from the cassette can commence, with multiple substrates passing through the CMP system simultaneously.

Each monitor wafer is sent to the in-line metrology device, where the layer thickness is measured (step 410). If the layer thickness is outside the control limits, then the default polishing time can be adjusted for any substrates that remain to be polished from the cassette (step 412). The time adjustment can be proportional to the amount of overpolishing or underpolishing, or it can be based on a look-up-table. On the other hand, if the layer thickness is within the control limits, then no adjustment need be made (step 414). Once all of the regular wafers have been polished, any gating or monitor wafers that were underpolished and outside the specification limits can be returned from the cassette to the polishing apparatus to be reworked (step 414).

The present invention has been described in terms of a number of embodiments. The invention, however, is not limited to the embodiments depicted and described. Rather, the scope of the invention is defined by the appended claims.

What is claimed is:

1. A method of controlling a chemical mechanical polishing system, comprising:

receiving a plurality of tolerance limits;

polishing a first substrate with the chemical mechanical polishing system;

measuring a thickness of at least one layer in the first substrate at an in-line metrology station;

determining which, if any, of the tolerance limits are exceeded by the thickness measured; and if it is determined that any of the tolerance limits are exceeded, selecting one of a plurality of procedures of the chemical mechanical polishing system, the selection being based on a result of the determining step.

2. The method of claim 1, wherein the plurality of procedures includes adjusting a polishing time of a second substrate from the same cassette as the first substrate.

3. The method of claim 1, wherein the plurality of procedures includes adjusting a polishing time of a second substrate from a different cassette from the first substrate.

4. The method of claim 1, wherein the plurality of procedures includes displaying a warning message.

5. The method of claim 1, wherein the plurality of procedures includes designating a gating substrate in the next cassette.

6. The method of claim 1, wherein the selection is based on which of the plurality of tolerance limits are exceeded.

7. The method of claim 1, wherein the plurality of tolerance limits includes an inner tolerance limit, an outer tolerance limit, and a specification tolerance limit.

8. The method of claim 1, wherein the plurality of wafer types includes a gating wafer type, a monitor wafer type, a regular wafer type, and a user defined wafer type.

9. The method of claim 1, wherein the plurality of procedures include predefined procedures.

10. A method of controlling a chemical mechanical polishing system, comprising:

receiving a plurality of tolerance limits, polishing a first substrate with the chemical mechanical polishing system, wherein the first substrate is one of a plurality of wafer types;

measuring a thickness of at least one layer in the first substrate at an in-line metrology station;

determining which, if any, of the tolerance limits are exceeded by the thickness measured;

if it is determined that any of the tolerance limits are exceed, selecting one of a plurality of procedures of the chemical mechanical polishing system; and receiving information identifying the wafer type of the first substrate, wherein the selection of one of the plurality of procedures is based on a result of the determining step and the wafer type of the first substrate.

11. A method of controlling a chemical mechanical polishing system, comprising:

receiving a plurality of tolerance limits;

polishing a first substrate with the chemical mechanical polishing system;

measuring a thickness of at least one layer in the first substrate at an in-line metrology station;

determining which, if any, of the tolerance limits are exceeded by the thickness measured; and if it is determined that any of the tolerance limits are exceeded, selecting one of a plurality of procedures of the chemical mechanical polishing system, the selection being based on a result of the determining step, wherein the selected one of the plurality of procedures is immediately stopping polishing and idling, completing polishing of substrates currently loaded in the chemical mechanical polishing system and then idling, completing polishing of substrates in a cassette currently loaded in the chemical mechanical polishing system and then idling, adjusting a polishing time for other substrates in the cassette, adjusting the polishing time of substrates in other cassettes, requesting operator approval prior to adjusting the polishing time, requesting operator approval prior to adjusting a polishing procedure, returning the first substrate to the polishing apparatus, designating a gating group, generating a warning message, or generating a status message.

12. A method of chemical mechanical polishing, comprising:

polishing a first substrate in a lot at a polishing station of a chemical mechanical polishing apparatus that includes an in-line metrology station;

measuring a thickness of at least one layer in the first substrate at the in-line metrology station; and adjusting a polishing parameter based on the measurement of the first substrate; and polishing a second substrate at the polishing station with the adjusted polishing parameter.

13. The method of claim 12, wherein the thickness of the at least one layer is measured while a third substrate is being polished, and the second substrate is polished after the third substrate.

14. The method of claim 12, wherein the polishing parameter is adjusted if the measured thickness exceeds a tolerance limit.

15. The method of claim 14, wherein the tolerance limit is entered by a user.

16. The method of claim 12, wherein the polishing parameter is a polishing time.

* * * * *